US011434643B2

(12) United States Patent
Livengood et al.

(10) Patent No.: US 11,434,643 B2
(45) Date of Patent: Sep. 6, 2022

(54) MODULAR RAILING BALUSTER SYSTEM

(71) Applicants: Derrick Livengood, Delta Junction, AK (US); Danielle Livengood, Delta Junction, AK (US)

(72) Inventors: Derrick Livengood, Delta Junction, AK (US); Danielle Livengood, Delta Junction, AK (US)

( * ) Notice: Subject to any disclaimer, the term of this patent is extended or adjusted under 35 U.S.C. 154(b) by 4 days.

(21) Appl. No.: 17/117,363

(22) Filed: Dec. 10, 2020

(65) Prior Publication Data

US 2022/0186502 A1 Jun. 16, 2022

(51) Int. Cl.
*E04F 11/18* (2006.01)

(52) U.S. Cl.
CPC ..... *E04F 11/1817* (2013.01); *E04F 11/1842* (2013.01)

(58) Field of Classification Search
CPC . E04F 11/1817; E04F 11/1834; E04F 11/184; E04F 11/1842; E04F 11/1844; E04F 11/1848; E04F 11/1851; E04F 11/1853; E04F 11/1855; E04F 11/1859; E04F 11/1857; E04F 11/1861; E04F 2011/1806; E04F 2011/1823; E04F 2011/1825; E04F 2011/1829; E04F 2011/188; E04H 3/08; E06B 9/01
USPC ..... 52/106, 832, 833
See application file for complete search history.

(56) References Cited

U.S. PATENT DOCUMENTS 465,509 A * 12/1891 Woelfel ..... A47G 27/0218 52/106
1,962,569 A * 6/1934 Miller ..... E06B 9/01 160/225
2,240,355 A * 4/1941 Swimley ..... B62B 1/145 414/490
D174,751 S * 5/1955 Hutar ..... D25/48.8
2,743,544 A * 5/1956 Wilson ..... E06B 9/01 24/703.1
2,916,113 A * 12/1959 Lee ..... E06B 9/01 D25/48.8
3,092,372 A * 6/1963 Cougle ..... E04F 11/1842 256/22
3,233,377 A 2/1966 Louis
5,056,283 A 10/1991 Sapinski
6,374,562 B1 4/2002 Crowly
6,775,937 B2 8/2004 Ruana
(Continued)

*Primary Examiner* — Kyle J. Walraed-Sullivan
(74) *Attorney, Agent, or Firm* — Boudwin Intellectual Property; Daniel Boudwin

(57) ABSTRACT

A modular railing baluster system includes a mounting device having an upper connector that may connect to an upper railing or other upper support surface and a lower connector that may connect to a lower railing or other lower support surface. The mounting device may include various shapes and may secure various objects within the railing system, such as a picture frame or similar display article, as one example. The system further includes one or more offset balusters that may be arranged in a symmetrical mirrored orientation on opposing sides of the mounting device. The offset middle portion of the offset baluster may maintain even spacing between the offset baluster and the mounting device. The system may further include additional vertical balusters for integration into an existing railing system and customized spacing of multiple mounting devices along the length of the railing system.

17 Claims, 6 Drawing Sheets

(56) References Cited

U.S. PATENT DOCUMENTS

| | | | | |
|---|---|---|---|---|
| 2008/0169456 | A1* | 7/2008 | Ross | E04F 11/1812 256/59 |
| 2010/0095567 | A1 | 4/2010 | Li | |
| 2013/0081340 | A1 | 4/2013 | Williams | |

* cited by examiner

MODULAR RAILING BALUSTER SYSTEM

BACKGROUND OF THE INVENTION

The present invention generally relates to a modular railing baluster system. More specifically, the present invention provides a modular railing baluster system that includes a mounting device for securing various items between the balusters of the railing system.

Railing systems are often utilized as a common and necessary safety addition to stairs, decks, and other areas that include a drop in height from one surface to another. Railing systems typically include multiple vertical balusters that are spaced along the length of a top railing. The lower ends of the balusters are typically connected to a lower railing or another lower supporting surface, such as a stair tread, for example. The balusters support the upper railing at its intended height and are usually spaced apart from one another at an even distance. That distance is usually regulated to be four inches or less in order to prevent an individual from accidentally falling through the balusters. In some instances, balusters deviate from a standard vertical support and include various decorative elements and other physical attachments or shapes. Individuals may customize the look of their stairway with various types of baluster arrangements and styles.

Devices have been disclosed in the known art that relate to baluster and railing systems that provide an alternative to the typical vertical baluster arrangement. However, the devices have several drawbacks. Most of the known art devices provide balusters having alternative designs to vertical balusters that are merely decorative and provide no additional utility. There exist fasteners that can be used to secure items to balusters. However, these fasteners may not be designed for different types and sizes of balusters and may cause structural damage to the baluster.

Specifically, the known art is lacking a means for securing a desired object within the confines of the balusters or railing system itself. In order to address these concerns, the present invention provides a modular railing baluster system with at least one baluster that additionally provides as a mounting device for any mounting any desired object within the confines of the railing system. The mounting device may be surround by other specifically sized balusters that maintain a proper safe spacing between themselves. In this way, an individual can customize their railing system with various accessory items depending on the configuration of each mounting device being used.

In light of the devices disclosed in the known art, it is submitted that the present invention substantially diverges from the prior art and consequently it is clear that there is a need in the art for an improvement to existing railing and baluster systems. In this regard the instant invention substantially fulfills these needs.

SUMMARY OF THE INVENTION

In view of the foregoing disadvantages inherent in the known types of railing and baluster systems now present in the prior art, the present invention provides a new and modular railing baluster system wherein the same can be utilized for providing convenience for the user when customizing a railing system to include balusters that support various objects.

In one embodiment, the modular railing baluster system includes a mounting device having an upper end and a lower end, an upper connector affixed to the upper end of the mounting device, a lower connector affixed to the lower end of the mounting device, and an offset baluster member having an upper portion and a lower portion that are aligned parallel to a middle offset portion. The mounting device can be configured to secure any kind of object within the railing system.

In one embodiment, an assembled modular railing baluster system according to the present invention includes a mounting device having an upper end and a lower end, an upper connector having a lower end affixed to the upper end of the mounting device and an upper end affixed to an upper support surface, a lower connector having an upper end affixed to the lower end of the mounting device and a lower end affixed to a lower support surface, and a pair of offset baluster members, each offset baluster member having an upper portion secured to the upper support surface and a lower portion secured to the lower support surface, wherein the upper portion and the lower portion of each baluster is aligned and spaced parallel from a middle offset portion. The offset portions may be surrounded on either side by vertical balusters. The ultimate arrangement and combination of baluster types may vary according to individual preference.

It is therefore an object of the present invention to provide a new and improved modular railing baluster system that addresses features lacking in the known art, namely the ability to secure an object within a railing system between different balusters.

It is another object of the present invention to provide an embodiment of the modular railing baluster system that is configured to maintain a distance of no greater than four inches of space between all adjacent balusters regardless of baluster size and type.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
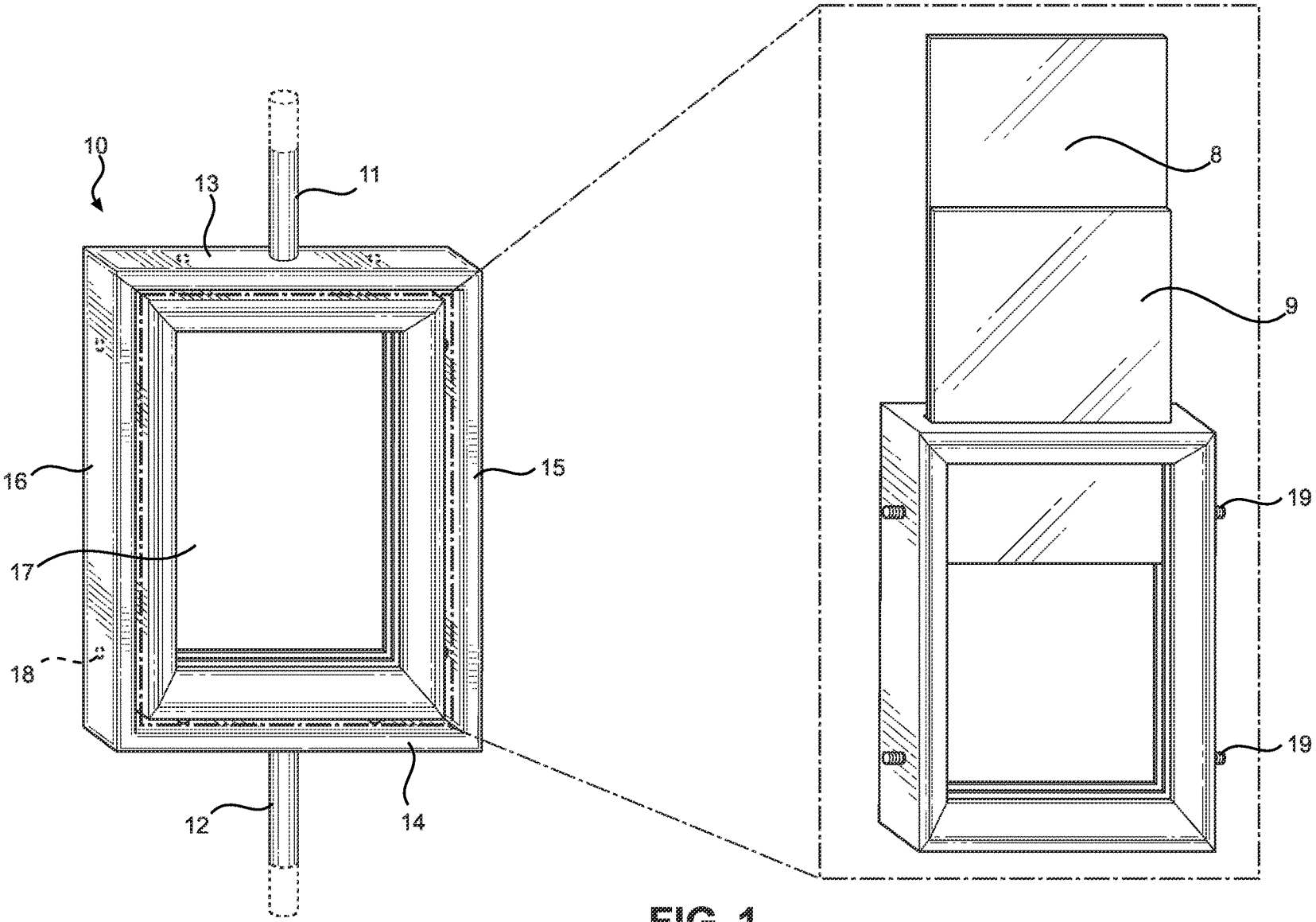
FIG. 1 shows a perspective view of one version of the mounting device of one embodiment of the modular railing baluster system.

Reference is made herein to the attached drawings. Like reference numerals are used throughout the drawings to depict like or similar elements of the modular railing baluster system. The figures are intended for representative purposes only and should not be considered to be limiting in any respect.

Referring now to FIG. 1, there is shown a perspective view of one version of the mounting device of one embodiment of the modular railing baluster system. In the shown embodiment, the mounting device 10 is a holder for a picture frame and includes an upper end 13, a lower end 14, and a pair of opposing vertical sides 15, 16 that define a rectangular support. An upper connector 11 is affixed to the upper end 13 of the mounting device 10 and a lower connector 12 is affixed to the lower end 14 of the mounting device 10. In the shown embodiment, the upper and lower connectors 13, 12 are elongated rods that resemble a typical vertical baluster and provide support for the mounting device 10. In other embodiments, the upper and lower connectors 13, 12 can include different shapes and sizes. The upper and lower connectors 13, 12 may be integral to the mounting device 10 or may be separately attached and adjustable.

In the shown embodiment, the mounting device 10 includes multiple mounting apertures 18 that receive mounting fasteners such as a screw 19 or the like. A picture frame 17 is removably secured within the mounting device 10 via the screws 19 and the mounting apertures 10. The picture frame 17 may include a pair of transparent covers 8, 9 that allow an image to be supported within the frame 17 facing either direction. This allows individuals on either side of a railing system to view an image supported within the frame 17. However, while the shown embodiment includes a picture frame 17, any object may be supported within the mounting device 10.

Figure 2:
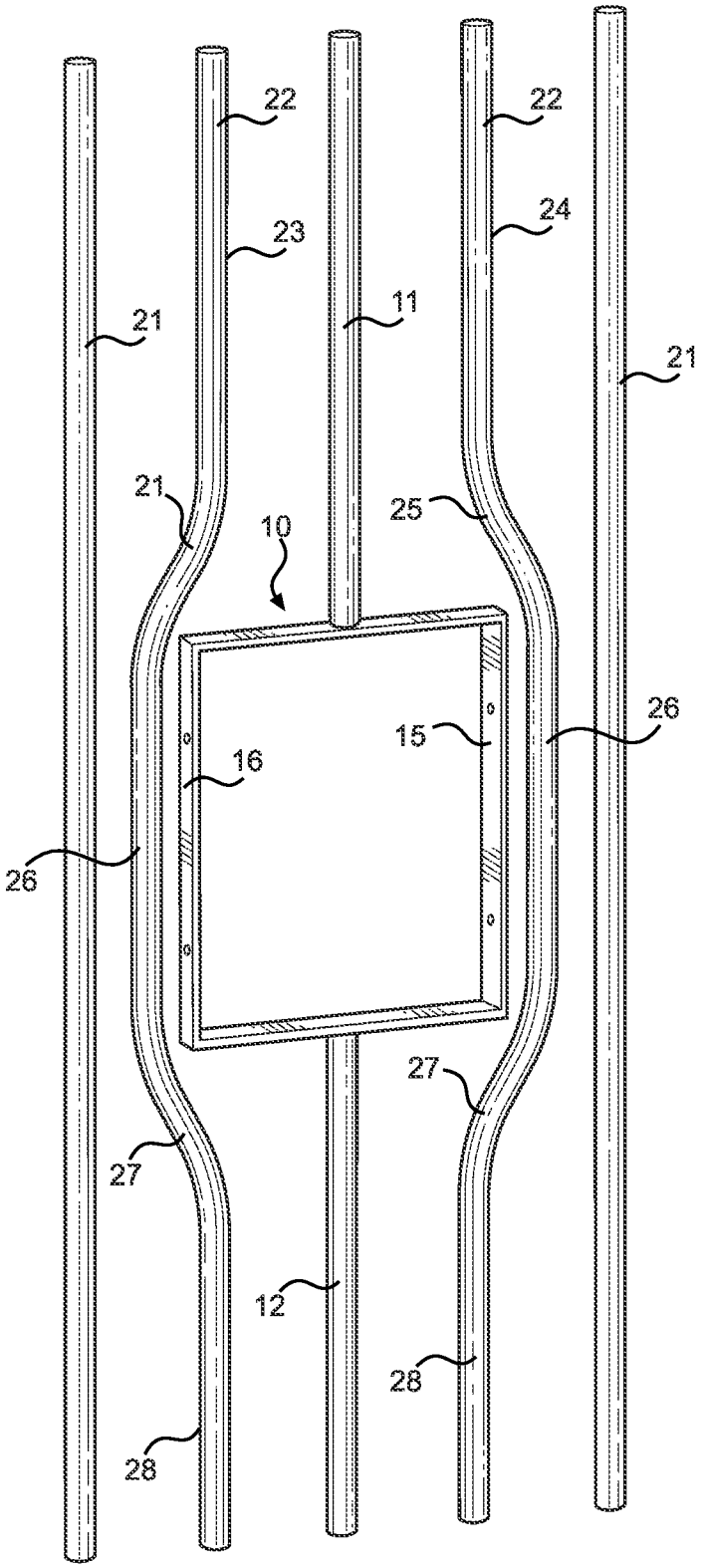
FIG. 2 shows a perspective view of one embodiment of the modular railing baluster system in an example arrangement.

Referring now to FIG. 2, there is shown a perspective view of one embodiment of the modular railing baluster system in an example arrangement. The mounting device 10 is shown positioned between a pair of offset balusters 23, 24, such that the exterior sides 15, 16 of the mounting device are each adjacent to one of the offset balusters 23, 24. Each offset baluster 23, 24 includes an upper portion 22 extending upwardly from a curved upper end 25 of a middle offset portion 26 and a lower portion 28 extending downwardly from a curved lower end 27 of the offset middle portion 26. The upper portion 22 and the lower portion 28 of each offset baluster 23, 24 is aligned and spaced parallel from the middle offset portion 26. In one embodiment, the mounting device 10 is bound between the offset balusters 23,24 such that no break between balusters greater than four inches may occur, which is the typical required minimum safety distance for baluster spacing. Further, in the shown embodiment, the system also includes a pair of vertical balusters 21. Each vertical baluster 21 is positioned adjacent one of the offset balusters 23, 24 in the illustrated arrangement. However, other combinations and arrangements of vertical balusters 21 and offset balusters 23, 24 may be utilized, including embodiments with no vertical balusters 21.

Figure 3:
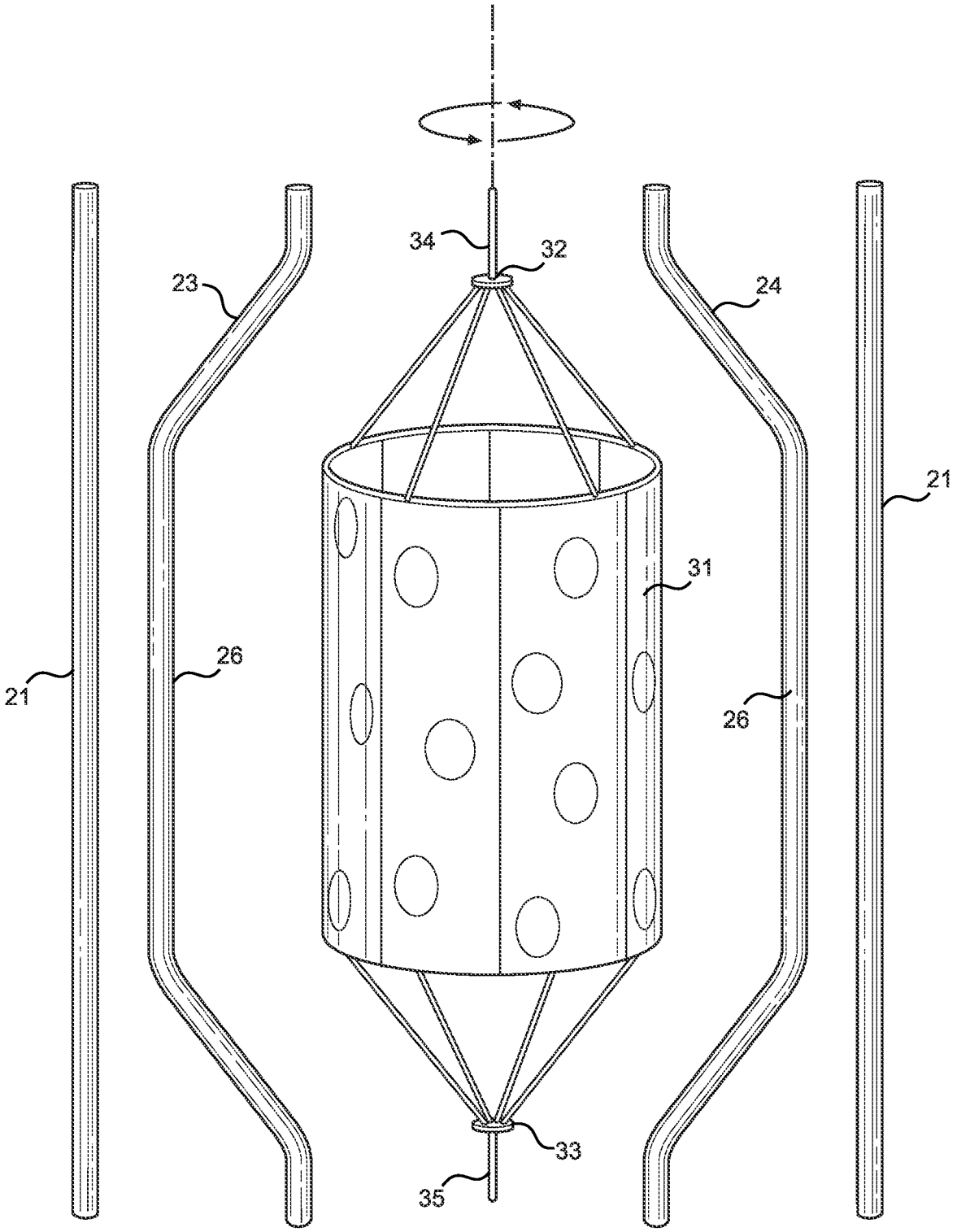
FIG. 3 shows a perspective view of a second version of the mounting device of one embodiment of the modular railing baluster system.

Referring now to FIG. 3, there is shown a perspective view of a second version of the mounting device of one embodiment of the modular railing baluster system. In the shown embodiment, the mounting device includes a rotating fixture 31. In this embodiment, the rotating fixture 31 has its lower support 35 rotatably connected thereto, which may be accomplished via a lower rotating connector 33. Similarly, the rotating fixture 31 also has its upper support 34 rotatably connected thereto, which may be accomplished via an upper rotating connector 32. This allows for rotation of the rotating fixture 31 in various forms of operation. For example, in some embodiments the rotating fixture 31 can be manually rotated to a desired orientation, while in other embodiments the rotating fixture 31 can be rotated via a motor or other powered device. In one instance, the rotating fixture 31 can be housed around a light source to provide a decorative yet functional light that illuminates the area surrounding the railing system. In the shown embodiment, the offset middle portion 26 of the offset balusters 23, 24 maintain the even safe distance on either side of the rotating fixture 31, while the vertical balusters 21 are shown at proper safe distance from the offset balusters 23, 24.

Figure 4:
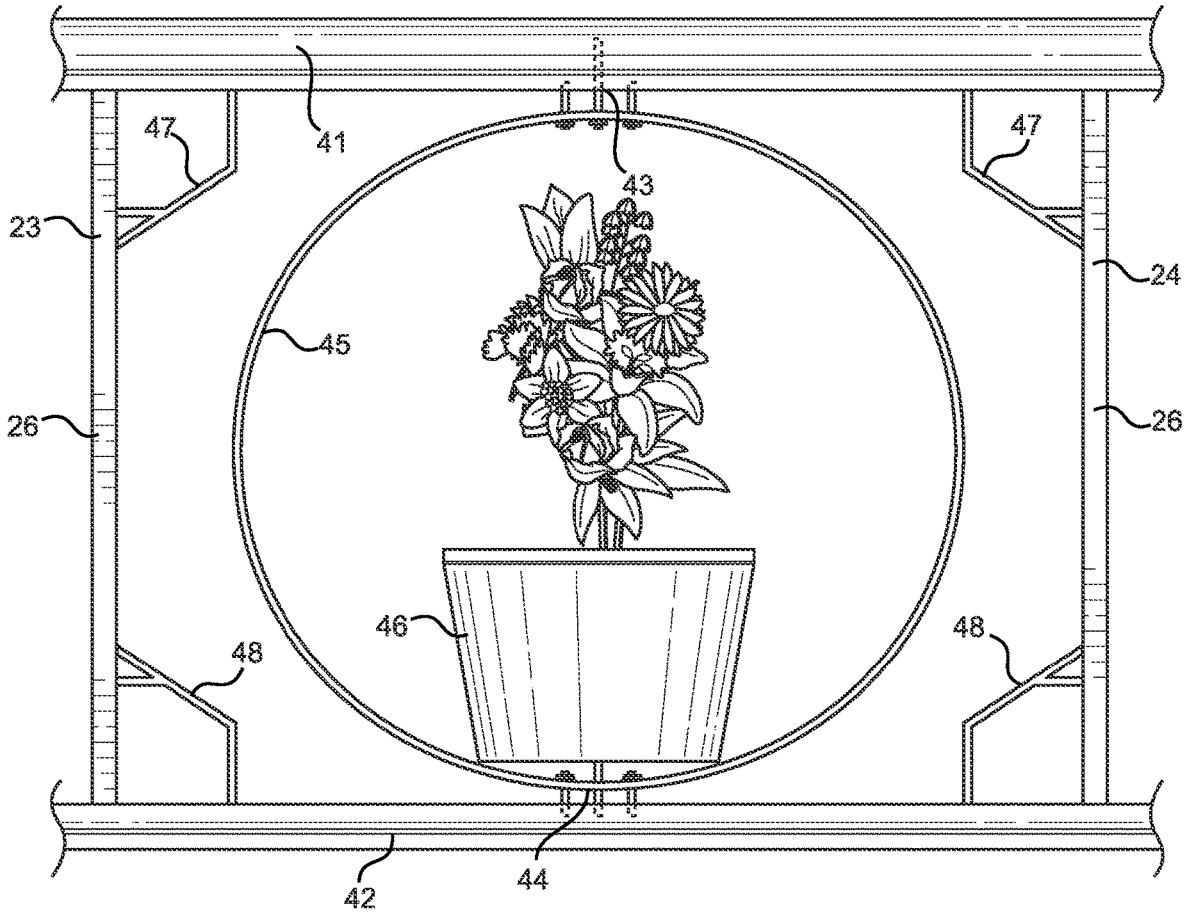
FIG. 4 shows a perspective view of a third version of the mounting device of one embodiment of the modular railing baluster system.

Referring now to FIG. 4, there is shown a perspective view of a third version of the mounting device of one embodiment of the modular railing baluster system. In the shown embodiment, the upper and lower connectors 43, 44 secure a circular central frame 45 that serves as the mounting device. The upper and lower connectors 43, 44 secure the circular central frame 45 to the upper and lower railings 41, 42, respectively. In the shown embodiment, the offset middle portions 26 of the offset balusters 23, 24 extend to connect between the upper and lower railings 41, 42 to provide additional structural support and rigidity. The curved upper and lower ends 47, 48 of the offset portions 26 general contour to the shape of the central frame 45 to maintain the correct and safe spacing. In the shown embodiment, a flower pot is secured within the circular frame 45, but any other object may be secured within the circular frame 45.

Figure 5:
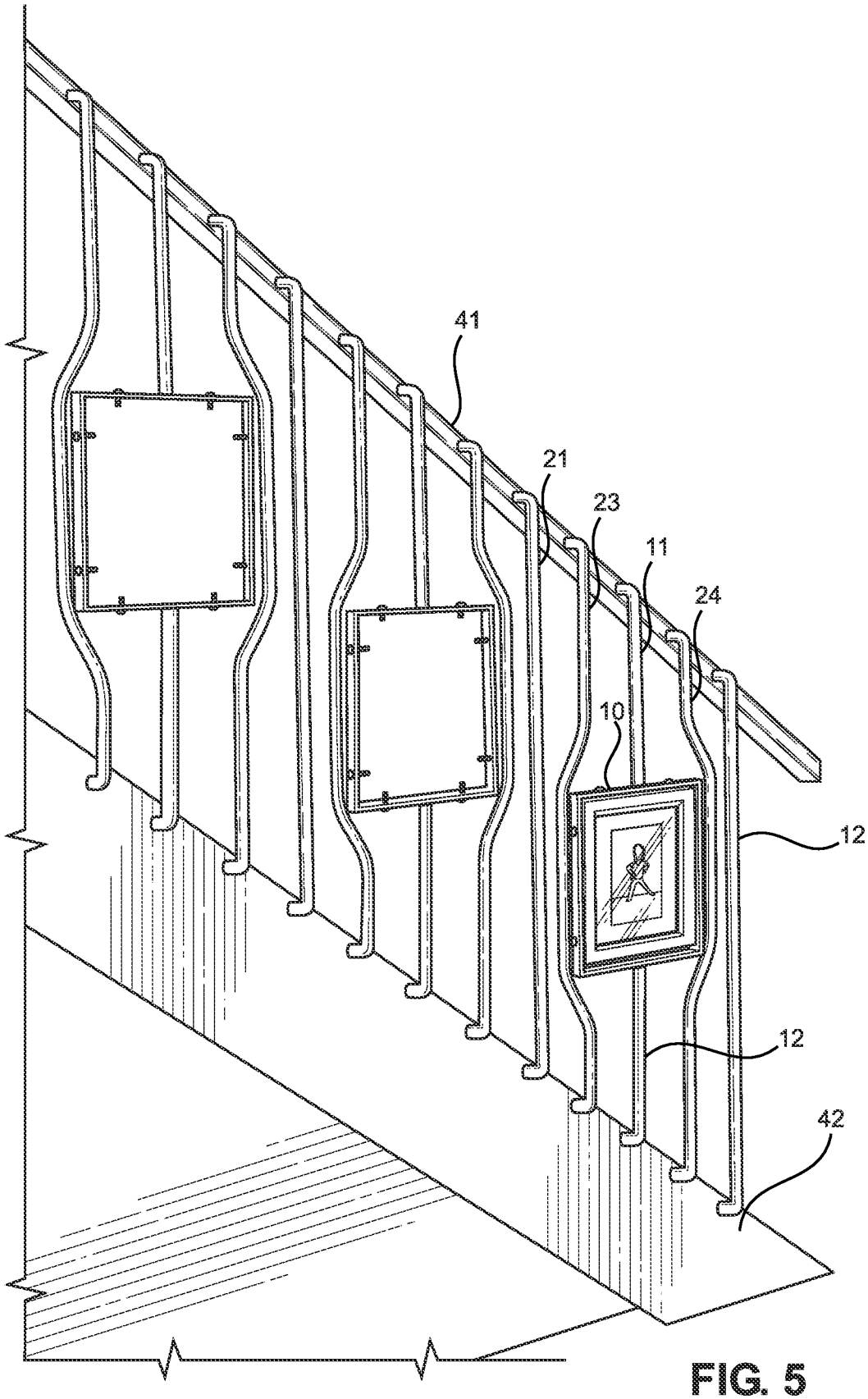
FIG. 5 shows a perspective view of an example installation of an embodiment of the modular railing baluster system with standoff type balusters.
Figure 6:
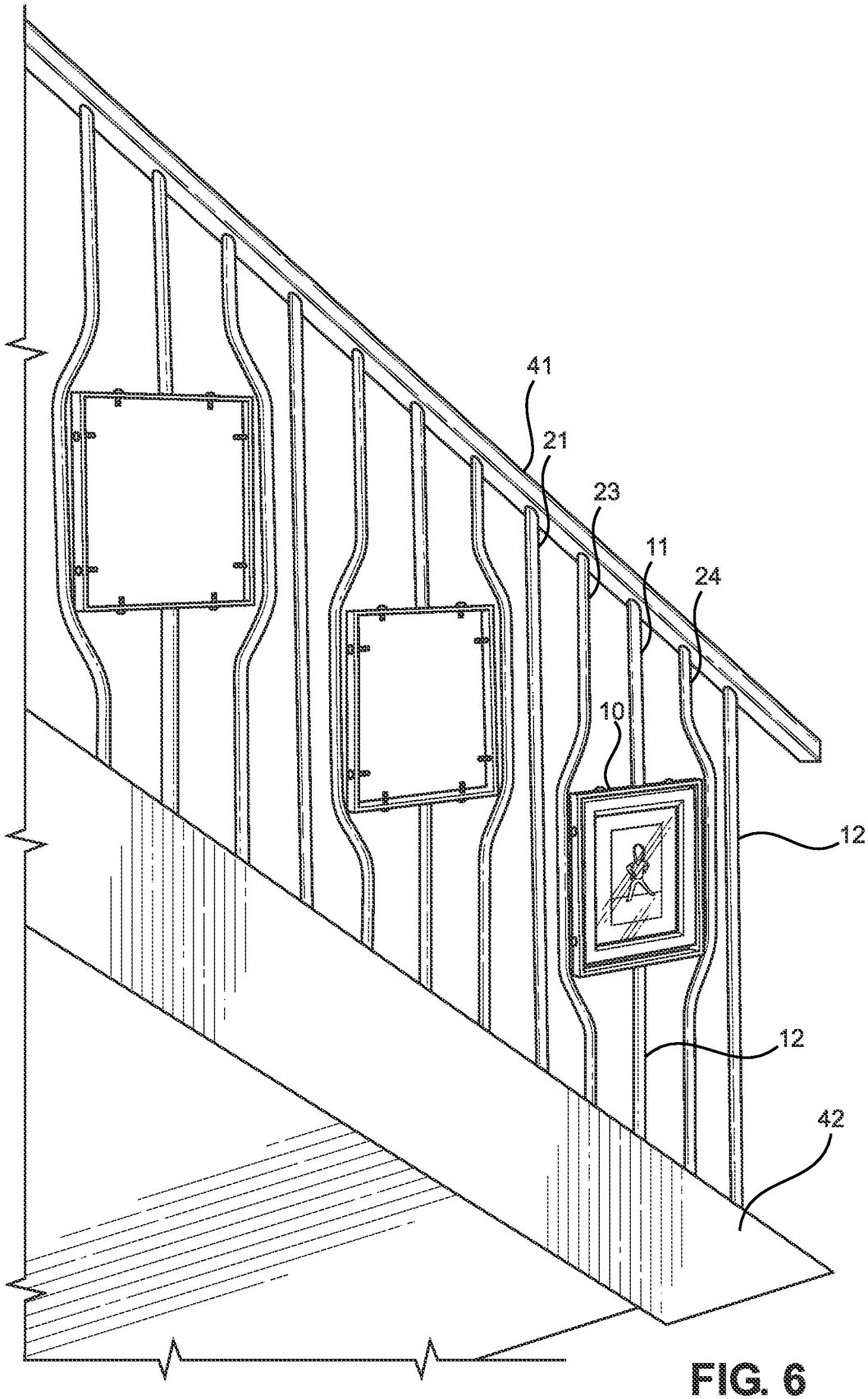
FIG. 6 shows a perspective view of an example installation of an embodiment of the modular railing baluster system with straight type balusters.

Referring now to FIGS. 5 and 6, there are shown a perspective view of an example installation of an embodiment of the modular railing baluster system with standoff type balusters and a perspective view of an example installation of an embodiment of the modular railing baluster system, respectively. In the shown embodiment, the mounting device's 10 upper connector 11 secures to the upper railing 41 and the lower connector 12 secures to the lower railing or base rail 42. The offset balusters 23, 24 are mirrored and positioned on opposing sides of the mounting device 10 while also extending between the upper and lower railings 41, 42. The present invention can be utilized in a standoff configuration, as illustrated in FIG. 5, or may include more traditional straight-end balusters, as shown in FIG. 6. In the standoff configuration shown in FIG. 5, the offset baluster members 23, 24, the vertical baluster members 21, and the upper and lower connectors 11, 12, each includes a pair of opposing curved ends that extend laterally outwardly from the upper railing 41 and the lower railing or base rail 42.

Overall, the examples shown in the drawings are not intended to be limiting. The scope of the present invention is intended to encompass any type of mounting device positioned adjacent a baluster in such a way that a desired distance between the baluster and the mounting device is not exceeded. The previously presented drawings and example assemblies are but a few of many examples of how the present invention may be embodiment in physical form.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modular railing baluster system, comprising:

a mounting device having an upper end and a lower end; an upper connector affixed to the upper end of the mounting device;

a lower connector affixed to the lower end of the mounting device;

an offset baluster member having an upper portion and a lower portion that are aligned parallel to a middle offset portion;

a vertical baluster member directly adjacent the offset baluster member, wherein the vertical baluster member is linear;

wherein a continuous gap is defined between the middle offset portion of the offset baluster member and the vertical baluster member.

2. The modular railing baluster system of claim 1, wherein the upper connector and the lower connector comprise vertical support members.

3. The modular railing baluster system of claim 1, wherein the upper connector is rotatably connected to the upper end of the mounting device.

4. The modular railing baluster system of claim 1, wherein the lower connector is rotatably connected to the lower end of the mounting device.

5. The modular railing baluster system of claim 1, wherein the mounting device includes a plurality of mounting apertures configured to receive a plurality of mounting fasteners.

6. The modular railing baluster system of claim 1, wherein the vertical baluster member includes a standoff configuration, such that the vertical baluster member includes a middle portion with a pair of opposing curved ends that extend laterally outwardly from a railing.

7. The modular railing baluster system of claim 1, further comprising an adjustable fastener affixed to the mounting device.

8. The modular railing baluster system of claim 1, further comprising a picture frame removably secured within an open center portion of the mounting device.

9. The modular railing baluster system of claim 1, wherein the offset baluster member includes a standoff configuration, such that the offset baluster member includes a middle portion with a pair of opposing curved ends that extend laterally outwardly from a railing.

10. The modular railing baluster system of claim 1 wherein the vertical baluster member includes a standoff configuration, such that the vertical baluster member includes a middle portion with a pair of opposing curved ends that extend laterally outwardly from a railing.

11. A modular railing baluster system, comprising:

a mounting device having an upper end and a lower end;

an upper connector comprising a lower end affixed to the upper end of the mounting device and an upper end affixed to an upper support surface;

a lower connector comprising an upper end affixed to the lower end of the mounting device and a lower end affixed to a lower support surface;

a pair of offset baluster members, each offset baluster member comprising an upper portion secured to the upper support surface and a lower portion secured to the lower support surface, wherein the upper portion and the lower portion of each offset baluster member is aligned and spaced parallel from a middle offset portion;

wherein a continuous gap is defined between the middle offset portion of each offset baluster member and a directly adjacent linear vertical baluster member member.

12. The modular railing baluster system of claim 11, further comprising a pair of vertical balusters each having an upper end connected to the upper support surface and a lower end connected to the lower support surface, wherein the mounting device and the pair of offset balusters are positioned between the pair of vertical balusters.

13. The modular railing baluster system of claim 11, further comprising a plurality of gaps defined by the positioning of the pair of vertical balusters, the pair of offset balusters, and the mounting device, wherein each gap of the plurality of gaps comprises a width that is less than or equal to four inches.

14. The modular railing baluster system of claim 11, further comprising an adjustable fastener affixed to the mounting device.

15. The modular railing baluster system of claim 11, further comprising a picture frame removably secured within an open center portion of the mounting device.

16. The modular railing baluster system of claim 11, wherein the mounting device is configured to rotate with respect to the upper surface and the lower surface.

17. The modular railing baluster system of claim 11, wherein the offset baluster member includes a standoff configuration, such that the offset baluster member includes a middle portion with a pair of opposing curved ends that extend laterally outwardly from a railing.

* * * * *